United States Patent [19]

Minasy

[11] Patent Number: 4,531,264

[45] Date of Patent: Jul. 30, 1985

[54] THEFT DETECTION SYSTEM TARGET FASTENER

[75] Inventor: Arthur J. Minasy, Woodbury, N.Y.

[73] Assignee: Knogo Corporation, Hicksville, N.Y.

[21] Appl. No.: 517,727

[22] Filed: Jul. 27, 1983

[51] Int. Cl.[3] ..... A44B 9/00

[52] U.S. Cl. ..... 24/155 BR; 24/150 R; 24/150 P

[58] Field of Search ..... 24/150 R, 150 P, 150 FP, 24/152, 90 R, 90.5, 155 BR, 136 R, 49 CP, 49 P; 292/251.5, 252

[56] References Cited

U.S. PATENT DOCUMENTS

| | | | |
|---|---|---|---|
| 208,753 | 10/1878 | Michelson | 24/90.5 |
| 1,492,853 | 5/1924 | Johnson | 24/155 BR |
| 2,266,432 | 12/1941 | Morin et al. | 24/150 P |
| 2,366,244 | 1/1945 | Ellerstein | 24/150 P |
| 2,611,168 | 9/1952 | Light | 24/150 P |
| 3,205,757 | 9/1965 | Kuennen | 24/150 P |
| 3,500,373 | 5/1966 | Minsy | 340/258 |
| 3,911,534 | 10/1975 | Martens et al. | 24/150 |
| 4,187,509 | 2/1980 | Weiner | 343/873 |
| 4,280,256 | 7/1981 | DeJong | 24/155 BR |
| 4,299,040 | 11/1981 | Minasy | 40/20 |
| 4,321,586 | 3/1982 | Cooper et al. | 340/572 |
| 4,339,853 | 7/1982 | Lipschitz | 24/155 BR |

FOREIGN PATENT DOCUMENTS

| | | | |
|---|---|---|---|
| 551143 | 3/1923 | France | 24/150 P |

OTHER PUBLICATIONS

Catalogue-Heico "Ziernägel Aller Art", pp. 4–7 and 9, no date given.

*Primary Examiner*—Victor N. Sakran

*Attorney, Agent, or Firm*—Fitzpatrick, Cella, Harper & Scinto

[57] ABSTRACT

A fastening assembly for fastening a wafer (10) to an article of merchandise (12) and comprising a locking mechanism in a housing (14) and a fastener element (16) having an expansive head (18) and a shank (20), formed with axially spaced circumferential grooves 22 for releasable locking engagement with a locking mechanism, the head having a conical exterior with an apex angle less than ninety degrees so that if the fastener element should fall onto a flat surface, the shank will slant upwardly less than forty five degrees; and downward pressure on the tip of the shank will cause it to tilt downwardly safely and without appreciable resistance.

10 Claims, 10 Drawing Figures

Fig. 1.
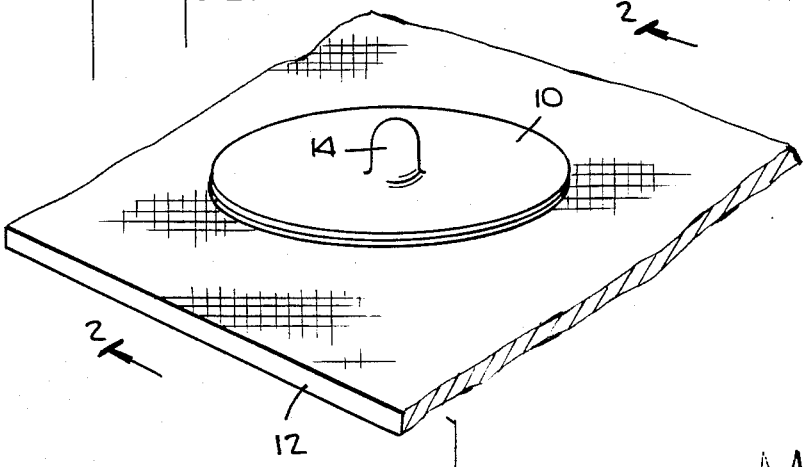
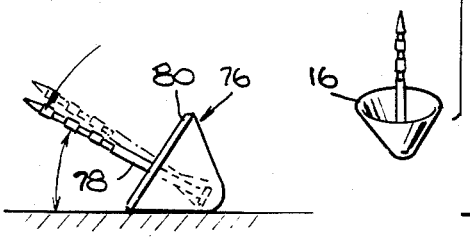
Fig. 10.
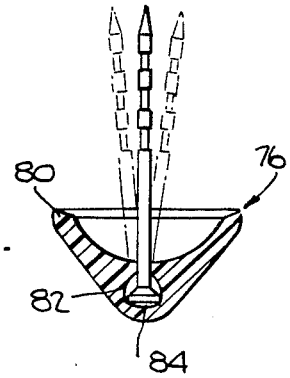
Fig. 9.
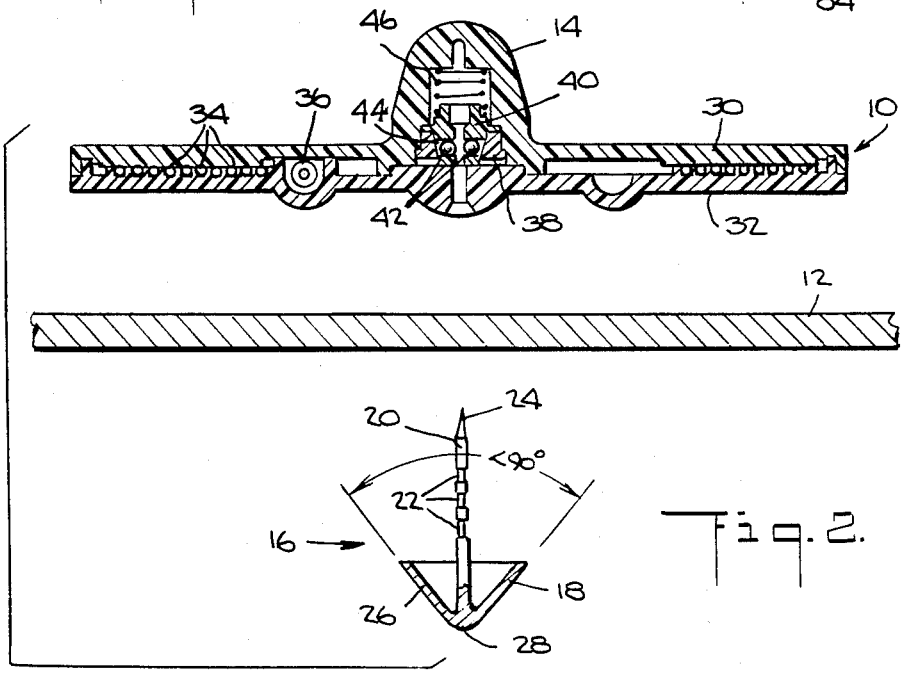
Fig. 2.

THEFT DETECTION SYSTEM TARGET FASTENER

BACKGROUND OF THE INVENTION

1. Field of the Invention

This invention relates to releasable fastening arrangements and more particularly it concerns a novel releasable fastening assembly and fastener element for temporarily but securely attaching plastic wafers to articles of merchandise.

2. Description of the Prior Art

The present invention is particularly useful with electronic theft detection systems for releasably fastening plastic wafers, which encase electronic target circuits, to articles of merchandise, Examples of such electronic theft detection systems, wafers and target circutis are shown and described in U.S. Pat. No. 3,500,373 and No. 4,321,586. As there shown, plastic wafers, in which electronic target circuits are embedded, are releasably attached to articles of merchandise by means of tack-like fastener elements having a large expansive head and a thin elongated pointed shank securely attached to and extending out from the head. The shank passes through the article of merchandise and through the wafer and into a releasable locking mechanism which is either integral with or separate from the wafer. The shank is configured to permit the locking mechanism to grip the side of the shank positively in the locked condition but to allow the shank to be withdrawn when the locking mechanism is in its released condition. The locking mechanism may be a ball and clutch type mechanism as shown and described in U.S. Pat. No. 3,911,534 (now disclaimed); and the shank of the fastener element, in order to provide workable locking interaction with the ball and clutch mechanism, is formed with circular grooves, as shown in U.S. Pat. No. 4,299,040.

When an electronic theft detection system is in operation and protecting merchandise, as in a store, the plastic wafers are attached to the articles of merchandise by means of the tack-like fastener elements and locking mechanisms so that they cannot be removed except by an authorized person, such as a sales clerk, with a special lock release device at a counter or checkout station. If the protected article is carried out from the store or protected area, it must pass near monitoring antennas; and if the wafer is still attached to the article, the electronic circuit embedded in the wafer will interact with an electromagnetic field in the vicinity of the antennas and cause a characteristic disturbance of that field that will be detected and will cause an alarm to sound. When, however, a legitimate purchase is made, the clerk or salesperson uses the special lock release device to release the lock and withdraw the tack-like fastener element so that the wafer can be removed from the article and the article can then be carried out past the interrogation antennas without activating the alarm.

It will be appreciated that in a busy store a very large number of these tack-like fastener elements are removed from locking mechanisms in a short period of time. Often, because of the haste involved in these operations, the fastener elements will fall on the floor and it may not be convenient to pick them up at once. If these fastener elements fall with their sharply pointed shanks extending upwardly, they can present a hazard to workers and others in the area. It is to this problem that the present invention is directed.

It is known in the prior art to form tacks or nails with heads of various different configurations for decorative purpose and it is also known that such different decorative configurations include upholstery nails with conical heads. However, those nails are not designed to be released from locking mechanisms and the problem of dropping, as described above, is not so prevalant with those nails, because they are used only once and are not unlocked for repeated use as are the fastener elements of this invention.

SUMMARY OF THE INVENTION

The present invention, in one aspect, provides a novel tack-like fastener element for releasably attaching plastic wafers to articles of merchandise. This novel fastener element comprises an expansive head and an elongated pointed shank securely attached to and extending out from the head. The pointed shank is configured for releasable attachment to a locking mechanism on a plastic wafer. The head has a conical outer configuration with an apex angle less than ninety degrees and a rounded tip. The center of gravity of the fastening element is located substantially farther away from the rounded tip then is its center of curvature. When the fastener element is dropped onto a horizontal surface, it will come to rest with its point extending either in a downwardly slanted direction or in an upwardly slanted direction less than forty five degrees from the horizontal so that, if the tip of the shank is pressed down upon, the point will tilt downwardly without appreciable resistance; and, if stepped upon, will not penetrate into one's foot.

In another aspect, the present invention provides a novel fastening arrangement for fastening plastic wafers to articles of merchandise. This novel fastening arrangement comprises a tack-like fastener element having an expansive head and an elongated pointed shank securely attached to and extending out from the head. The shank passes through an article of merchandise and a plastic wafer to be attached to the merchandise. There is also provided on the wafer a releasable locking mechanism which in the locked condition grips the shank and, in the unlocked condition, releases the shank and allows the fastener element to be withdrawn so that the plastic wafer can be removed from the article of merchandise. The head of the fastener element has a conical outer configuration with an apex angle less than ninety degrees and a rounded tip. The center of gravity of the fastening element is located substantially farther away from the rounded tip than its center of curvature. When the locking mechanism is released and the fastener element falls onto a horizontal surface it will come to rest with its point extending either in a downwardly slanted direction or in an upwardly slanted direction less than forty five degrees from the horizontal so that, if the tip of the shank is pressed down upon, the point will tilt downwardly without appreciable resistance; and if stepped on, it will not penetrate into one's foot.

BRIEF DESCRIPTION OF THE DRAWINGS

Various embodiments of the invention have been chosen for purposes of illustration and description and are shown in the accompanying drawings, forming a part of this specification wherein:

FIG. 1 is an exploded perspective view of a wafer and fastener assembly according to the present invention;

FIG. 2 is a section view taken along line 2—2 of FIG. 1;

FIG. 8 is a section view taken along line 8—8 of FIG. 7;

FIG. 9 is a section view of another alternate form of fastener element according to the present invention; and FIG. 10 is a side elevational view illustrating the orientation assumed by a dropped fastener element according to FIG. 9 when dropped onto a flat surface.

DETAILED DESCRIPTION OF THE PREFERRED EMBODIMENTS

Figure 3:
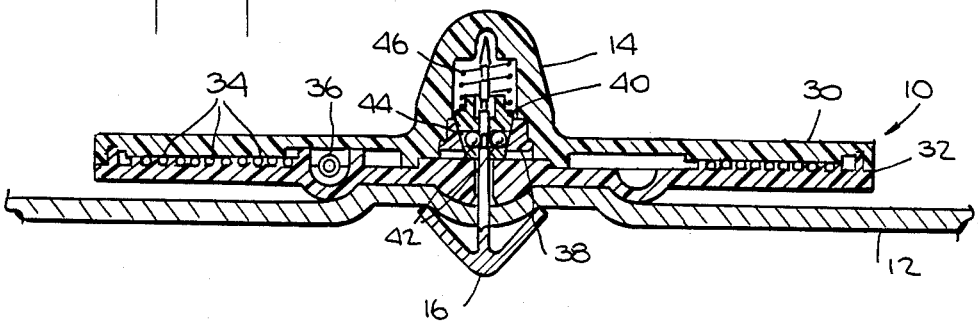
FIG. 3 is a view similar to FIG. 2 but showing the fastener assembly locking the wafer to an article of merchandise.

As shown in FIG. 1, a wafer 10 is arranged to be secured to an article of merchandise 12 by means of a releasable fastener assembly. The fastener assembly comprises a releasable locking mechanism contained within a dome shaped housing 14 molded into the wafer and a tack-like fastener element 16 which pierces the merchandise and enters into the housing 14 where it is held tightly by the locking mechanism.

The wafer 10 is a molded plastic assembly and may be of a construction as shown and described in U.S. Pat. No. 4,187,509. The wafer contains a resonant electrical circuit which cooperates with electronic detecting equipment, such as that shown and described in U.S. Pat. No. 3,500,373, to protect against the theft of the merchandise 12. When the merchandise with the wafer 10 attached thereto is carried through an interrogation zone (usually located at or near the exit of a store or department where the merchandise is kept), the resonant electrical circuit in the wafer produces a characteristic disturbance upon electromagnetic waves being generated in the interrogation zone. This disturbance is detected by the detecting equipment which causes an alarm to be activated. When the merchandise 12 is legitimately purchased, the sales clerk or other authorized person removes the wafer from the merchandise by releasing the locking mechanism with a special tool. The merchandise then may be carried through the interrogation zone without activating the alarm.

As shown in FIG. 2, the fastener element 16 comprises an expansive head 18 of special conical shape and a shank 20 which is specially configured for releasable attachment to a locking mechanism. Specifically, the shank 20 is provided with axially spaced apart circumferential grooves 22. The shank is also formed with a point 24 at one end; and the opposite end is securely attached to the head 18.

The head 18 of the fastener element has outer conical sides 26 and a rounded tip 28. The apex angle of the conical sides 26 is less than ninety degrees and the angle between the sides and the axis of the shank 20 is less than forty five degrees. Preferably, the apex angle of the conical sides is eighty degrees and the angle between the sides and the axis of the shank is forty degrees. In addition, for reasons to be explained hereafter, the center of gravity of the fastener element 16 is located substantially farther away from the rounded tip 28 than the center of curvature of the tip.

The merchandise 12, which is pierced by the shank 20 of the fastener element, may be any fabric-like object which it is desired to protect, e.g. a coat or a dress.

The wafer 10 is made up of upper and lower substantially flat molded plastic housing members 30 and 32, between which is contained a coil 34 and a capacitor 36 connected as resonant circuit. The details of the internal construction of the wafer are not part of this invention and will not be described in detail; but reference may be had to U.S. Pat. No. 4,187,509 for such detail. The upper housing member 30 is formed with the dome shaped housing 14 which contains a releasable locking mechanism. This locking mechanism may be a magnetically releasable mechanism such as shown in U.S. Pat. No. 3,911,534 (now disclaimed). As shown, the locking mechanism comprises an interiorly tapered retaining ring 38 fixed inside the housing 14, a movable insert 40 which carries locking balls 42 in a transverse passage 44 and a spring 46 which forces the insert downwardly into the tapered ring. When the insert is pressed down by the spring, the interior taper of the ring 38 forces the balls 42 in toward the axis of the housing. Turning now to FIG. 3 it will be seen that when the balls are forced toward the axis, they press into the circumferential grooves 22 of the fastener element shank fastener and thereby lock the shank tightly inside the housing. Any attempt to pull the fastener element out from the locking mechanism only causes the insert 40 to be pulled down and the balls to be wedged move tightly between the retaining ring 38 and the grooves 22 of the shank. The mechanism is released by applying a strong magnetic force which pulls the insert 40 up against the force of the spring 46. This allows the balls 42 to move apart and out of the grooves 22 of the fastener element shank 20 so that it can be withdrawn from the locking mechanism.

Figure 4:
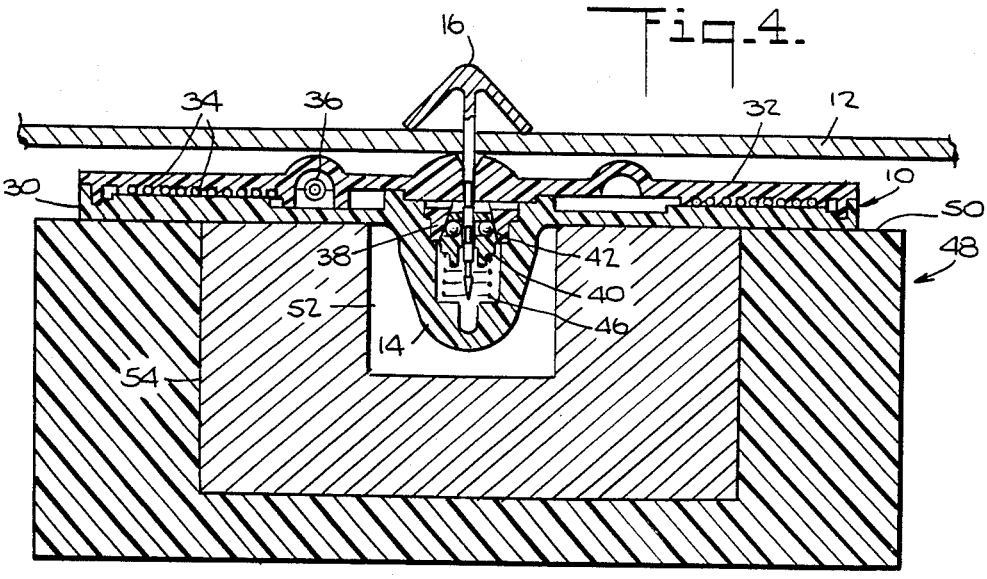
FIG. 4 is a side view, taken in section, showing a decoupler device used to unlock the fastening assembly of FIG. 1.

FIG. 4 shows a magnetic type decoupler 48 for operating the releasable locking mechanism in the wafer 10. The decoupler 48 has a flat upper surface 50 containing a depression 52 which accommodates the locking mechanism housing 14 of the wafer 10. Under the surface 50 and around the depression 52 there are provided permanent magnets 54 which are arranged to produce an axial downwardly directed magnetic force on metal elements placed in or near the depression. The decoupler 48 per se is not part of the invention and will not be described here in detail. A decoupler which may be used in this connection is shown and described in U.S. Pat. No. 4,339,853.

As can be seen in FIG. 4, the wafer 10 which is attached to the merchandise 12 is placed upside down on the upper surface of the decoupler 48 with the locking mechanism housing 14 extending into the depression 52. As a result of the magnetic forces produced by the decoupler, the insert 40 of the locking mechanism is pulled down so that the balls 42 are released from locking engagement with the grooves 22 of the shank 20 of the fastener element 16. The fastener element may then be removed from the wafer 10 along with the merchandise 12.

Figures 5, 6:
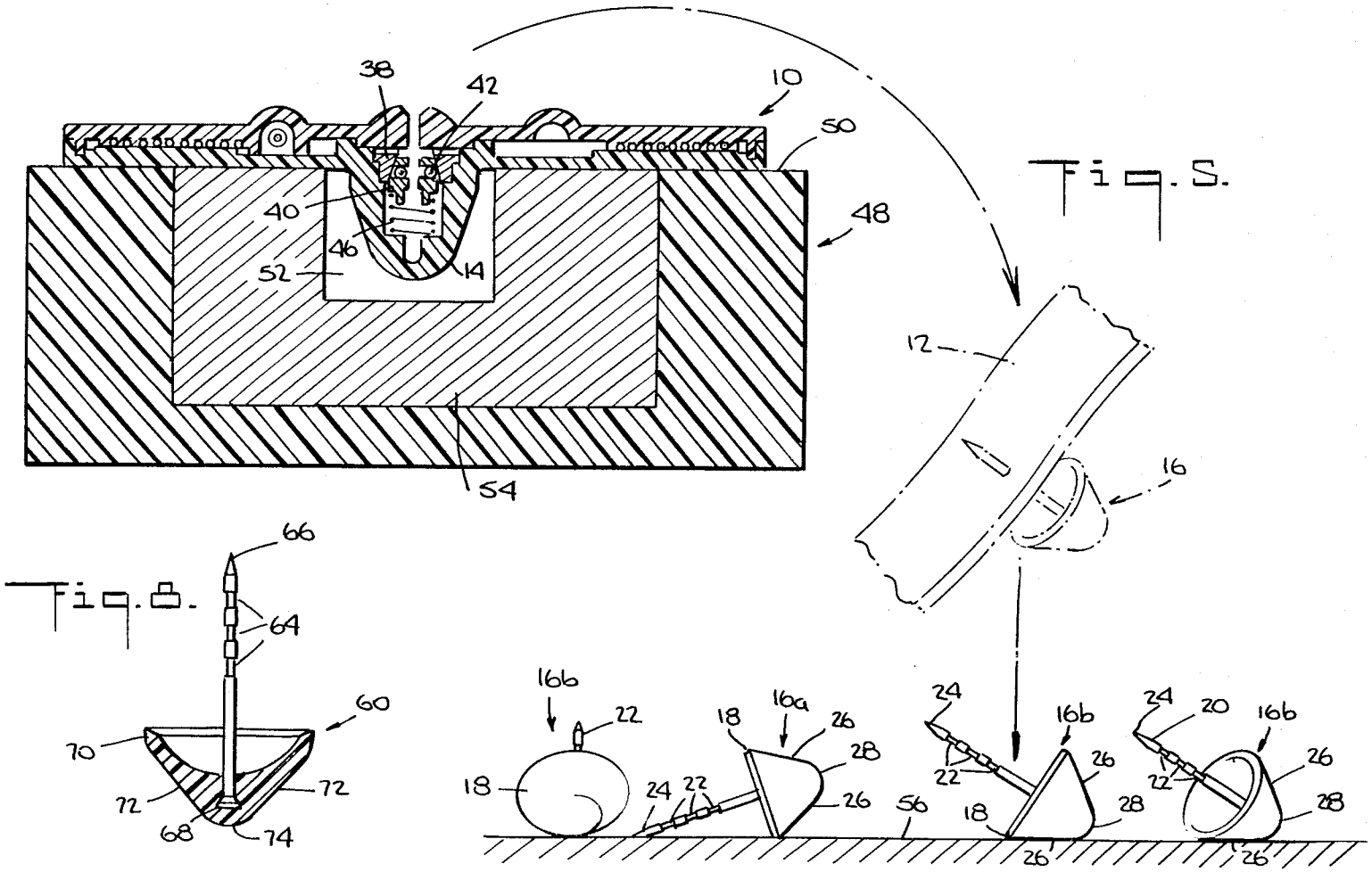
FIG. 5 is a view similar to FIG. 4 but showing the removal of the merchandise from the wafer and the dropping of removed fastener elements onto a flat surface.

When the merchandise is lifted off from the wafer 10, the fastener element 16 is lifted off with it as shown in FIG. 5. The fastener element 16 is then removed from the merchandise and is stored for reuse with the wafer on new merchandise.

Figure 6:
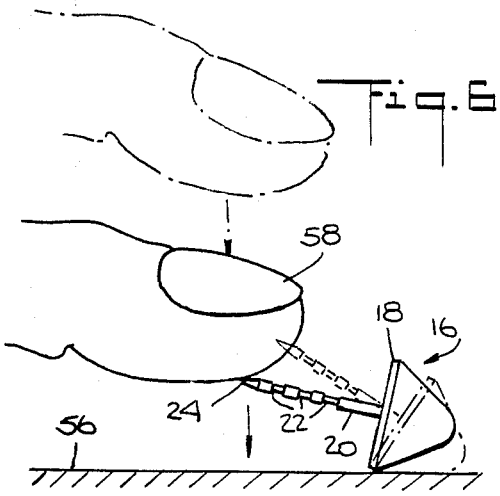
FIG. 6 is a side elevational view showing the manner in which a dropped fastener element reacts when pressed down upon.

It happens that after the merchandise 12 and fastener element 16 are lifted off from the wafer 10, as shown in FIG. 5, the fastener element 16 often falls onto the floor or onto the counter next to the decoupler. As illustrated in FIG. 5, the fastener elements 16, when dropped onto a flat surface 56, may assume either a slanting point down orientation, as indicated at 16*a*, or a slanting point up orientation, as indicated at 16*b*. Those fastener elements which come to rest in a point down orientation provide no danger insofar as their points 24 are concerned since the points lie along the surface 56. Furthermore, the fastener elements 16*b* which assume a slanting point up orientation do not present any danger as far as the point 24 is concerned because, due to the configuration of the head 18, the shank 20 of the fastener element extends upwardly at an angle less than 45° relative to the surface 56. As shown in FIG. 6, when one presses one's finger 58 straight down on the point 24 of the fastener element 16, the downward force of the finger is not resisted but instead the fastener element 16 tilts without appreciable resistance, as shown, from its phantom line position to its solid line position. The same reaction takes place when the fastener element is stepped on; an accordingly the point will not penetrate into one's foot.

The tilting characteristic of the fastener element under downward pressure is due to the shank extending outwardly at an angle less than forty five degrees relative to the horizontal. The downward forces of one's foot or hand will not be directed along the axis of the shank toward the head but instead those forces will cause the entire fastener element to tilt so that the shank slants downwardly.

The fastener element cannot assume a position with the shank pointing straight up because the center of gravity of the fastener element is farther away from the rounded tip of the head 24 than its center of curvature. Because of this the fastener element is not stable with its shank pointing straight up and it will fall to either position 16*a* or 16*b* as shown in FIG. 5.

The head 24 of the fastener element 16 preferably has a diameter of one half inch (12.7 mm.) and a height of one quarter inch (6.35 mm.); and the shank 26 extends a distance of about five eighths of an inch (15.9 mm.) out from the base of the head. The apex angle of the head 18 is preferably eighty degrees. This angle permits the shank to extend at an angle of about forty degrees from the horizontal so that it will be readily pushed down without appreciable resistance. At the same time the eighty degree apex angle of the head 18 is large enough to permit the head 18 to have an appreciable maximum diameter for holding the merchandise 12 without however, being inconveniently high.

Figure 7:
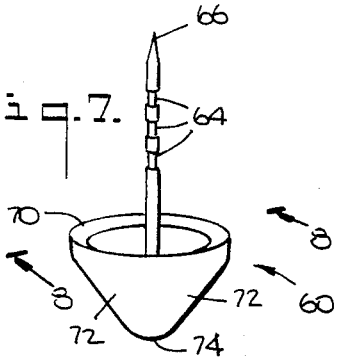
FIG. 7 is a perspective view of an alternate form of a fastener element according to the present invention.

FIGS. 7 and 8 show a modified fastener element 60 according to the invention. As can be seen the fastener element 60 comprises a thin elongated metal shank 62 formed with axially spaced apart circumferential locking grooves 64 toward its outer end. The outer end of the shank 62 is pointed as indicated at 66. The inner end of the shank 62 is formed with an enlargement 68 which is embedded into a plastic head 70. The head 70 may be of any strong plastic material but preferably it is formed of glass reinforced nylon. Also, in this embodiment, the maximum diameter of the head 70 is five eighths of an inch (15.9 mm.) and its height is three eighths of an inch (9.5 mm.). The shank 62 in this embodiment extends five eighths of an inch (15.9 mm.) out from the head. The head 70 is shaped similarly to the head 18 of the fastening element 10 of FIG. 2. Specifically, the head 70 has outer conical sides 72 and a rounded tip 74. The apex angle of the conical sides 72 is less than 90 degrees and the angle between the sides and the axis of the shank 62 is less than 45 degrees. Also, the center of gravity of the fastener element 60 is located substantially farther away from the rounded tip 74 than the center of curvature of the tip.

The use of a metal shank with a plastic head provides a fastener element which is especially strong, yet light in weight. Furthermore, such fastener element provides even less chance of injury when stepped on than does an all metal fastener.

FIGS. 9 and 10 show another modified fastener element 76 according to the invention. As seen in FIG. 9, the fastener element 76 comprises a thin elongated metal shank 78 of the same configuration and construction as the shank 62 of FIGS. 7 and 8, and an expansive head 80 of the same outer conical configuration as the head 70 of FIGS. 7 and 8. The head 80 may be of metal or plastic. The modification of FIGS. 9 and 10 is characterized by the provision of a cavity 82 in the head which loosely accommodates an enlargement 84 on the end of the shank 78. This cavity permits the head to rotate relative to the shank and it also permits the shank to tilt slightly from side to side as shown in FIG. 9. The purpose for this is to prevent the shank from being bent when attempts are made to pry the head 80 back and forth. This avoids work hardening and weakening of the shank which might result in breaking of the shank and release of the merchandise from the wafer. The fastener element 70 makes use of the principles described and claimed in U.S. Pat. No. 4,299,040. The arrangement of a tiltable shank in combination with the special conically shaped head in the present invention provides the additional advantage that when the fastener element lays on a flat surface 86 as shown in FIG. 10, the shank 78 extends upwardly at even less of an angle than it would if the shank were rigidly fixed inside the head 80. This enhances the tendency of the fastener element to tilt downwardly when pressed down upon in the manner illustrated in FIG. 6; and it permits a slightly greater apex angle for the conical head 80 which in turn minimizes the height which the head must have to provide a substantial maximum diameter for securing merchandise to a wafer.

It will be appreciated that the fastening assembly of the present invention is safer than prior art arrangements employing reuseable fastener elements, especially in the environment of a theft detection system where a large number of such fastener elements are applied to and removed from various articles of merchandise.

I claim:

1. A tack-like fastener element for releasably and securely attaching plastic theft detection wafers to articles of merchandise, said fastener element comprising an expansive head and an eleongated pointed shank securely attached to and extending out from said head, said pointed shank being formed with axially spaced circumferential grooves for releasable attachment to a locking mechanism on a wafer, said head having a conical outer configuration with an apex angle less than ninety degrees and a rounded tip, the center of gravity of said fastener element being located substantially farther away from said rounded tip than its center of curvature whereby said element, when dropped onto a horizontal surface, will come to rest with its point extending either in a downwardly slanted direction or in an upwardly slanted direction less than forty five degrees from the horizontal so that, if pressed down upon the point will be pushed down without appreciable resistance.

2. A tack-like fastener element according to claim 1 wherein said shank is made of metal and said head is made of plastic.

3. A tack-like fastener element according to claim 1 wherein said shank is loosely but securely attached to said head in a manner allowing said shank to tilt slightly relative to said head.

4. A tack-like fastener element according to claim 1 wherein the apex angle of said conical outer configuration is about eighty degrees.

5. A fastening assembly for fastening a target wafer of an electronic theft detection system to an article of merchandise, said assembly comprising a tack-like fastener element and a releasable locking mechanism, said fastener element comprising an expansive head and an elongated shank pointed at or end and securely attached at its other end to said head, said shank being configured for releasable lockin engagement with said locking mechanism, said head aving a conical outer configuration with an apex ang e less than ninety degrees and a rounded tip, the ce ter of gravity of said fastener element being locatec substantially farther away from said rounded tip than the center of curvature of said tip whereby said fastener element, upon release from said locking mechanism, will fall onto a flat surface with its shank entending either in a downwardly slanted direction or in an upwardly slanted direction at an angle less than forty five degrees from the horizontal so that, if pressed down upon, the point will be pushed down without appreciable resistance.

6. A fastening assembly according to claim 5 wherein said releasable locking mechanism is a ball clutch fastener.

7. A fastening assembly according to claim 6 wherein said pointed shank is formed with axially spaced apart circumferential grooves into which locking balls of said ball clutch fastener may extend.

8. A fastening assembly according to claim 5 wherein said shank is made of metal and wherein said head is made of plastic.

9. A fastening assembly according to claim 5 wherein said shank is loosely but securely attached to said head in a manner allowing said shank to tilt slightly relative to said head.

10. A fastening assembly according to claim, 5 wherein the apex of said conical outer configuration is about eighty degrees.

* * * * *